US011065494B1

(12) United States Patent
Chuang

(10) Patent No.: US 11,065,494 B1
(45) Date of Patent: Jul. 20, 2021

(54) EXERCISING DEVICE WITH REHABILITATION FUNCTION

(71) Applicant: High Spot Health Technology Co., Ltd., Taichung (TW)

(72) Inventor: Yen-Chi Chuang, Taichung (TW)

(73) Assignee: High Spot Health Technology Co., Ltd., Taichung (TW)

( * ) Notice: Subject to any disclaimer, the term of this patent is extended or adjusted under 35 U.S.C. 154(b) by 37 days.

(21) Appl. No.: 16/733,414

(22) Filed: Jan. 3, 2020

(51) Int. Cl.
*A63B 21/00* (2006.01)
*A63B 23/12* (2006.01)

(52) U.S. Cl.
CPC .... *A63B 21/00192* (2013.01); *A63B 21/4035* (2015.10); *A63B 21/4047* (2015.10); *A63B 23/1209* (2013.01); *A63B 2208/0228* (2013.01)

(58) Field of Classification Search
CPC ..... A63B 21/00192; A63B 21/4047; A63B 21/4035; A63B 2208/0228; A63B 23/1209; A63B 21/00–00192; A63B 22/00–0017
See application file for complete search history.

(56) References Cited

U.S. PATENT DOCUMENTS

2008/0051256 A1* 2/2008 Ashby ..... A63B 23/12 482/5
2009/0149302 A1* 6/2009 Thuma ..... A63B 21/0628 482/99
2016/0074698 A1* 3/2016 Figueroa ..... A47C 17/38 5/2.1
2016/0303418 A1* 10/2016 Canali ..... A63B 23/0355
2018/0133536 A1* 5/2018 Webber ..... A63B 23/03541
2018/0369644 A1* 12/2018 Slobodnik ..... A63B 21/4047

* cited by examiner

*Primary Examiner* — Andrew S Lo
(74) *Attorney, Agent, or Firm* — Karin L. Williams; Alan D. Kamrath; Mayer & Williams PC

(57) ABSTRACT

An exercising device includes a main frame, a seat, a backrest, a swing unit, a magnetically controlled damper, and an electronic control panel. The swing unit is swingably mounted on the upright of the main frame. The swing unit includes two handlebars extending from the upright to the seat respectively. The magnetically controlled damper is pivotally mounted between the swing unit and the main frame. The electronic control panel is electrically connected with the magnetically controlled damper. When the two handlebars are moved by the user, the magnetically controlled damper provides a damping force to retard movement of the two handlebars. The electronic control panel controls and regulates the resistance of the magnetically controlled damper.

11 Claims, 9 Drawing Sheets

EXERCISING DEVICE WITH REHABILITATION FUNCTION

BACKGROUND OF THE INVENTION

1. Field of the Invention

The present invention relates to an exercising device and, more particularly, to an exercising device with a rehabilitation function.

2. Description of the Related Art

A conventional rehabilitation apparatus comprises a support frame, a pedal mounted on the support frame, and a handle mounted on the support frame and connected with the pedal to move in concert with the pedal. Thus, when a user holds the handle and treads the pedal, the handle is driven by the pedal to move upward and downward so as to provide a rehabilitating function to the user's two hands. However, when the user's legs are injured, he/she cannot tread the pedal to drive the handle easily, thereby greatly causing inconvenience to the user, and thereby decreasing the rehabilitating effect of the rehabilitation apparatus.

A conventional upper arm rehabilitation apparatus comprises a main frame, two handlebars, a linking mechanism, and a transmission mechanism. The transmission mechanism includes a magnetically controlled resistance module. In operation, the user's two hands hold the two handlebars to perform a reciprocating movement along an arcuate track. When the two handlebars are moved, the linking mechanism and the transmission mechanism are driven simultaneously. At this time, the magnetically controlled resistance module of the transmission mechanism is used to apply a damping function, thereby achieving a purpose of exercising the user's arms efficiently. However, the linking mechanism includes multiple chains and gears, thereby increasing the cost of production and assembly. In addition, the linking mechanism is not assembled easily, thereby wasting the working time. Further, the magnetically controlled resistance module is composed of magnetically controlled wheels cooperating with belt wheels or metallic circular plates cooperating with magnetic members, thereby increasing the cost of fabrication. Further, the magnetically controlled resistance module has a larger volume, such that it is necessary to provide an additional space for mounting the magnetically controlled resistance module. Moreover, it is necessary to provide a support frame for mounting the magnetically controlled resistance module.

BRIEF SUMMARY OF THE INVENTION

The primary objective of the present invention is to provide an upper arm (or limb) exercising device with a linear retractable and magnetically controlled damping function.

In accordance with the present invention, there is provided an exercising device comprising a main frame, a seat, a backrest, a swing unit, a magnetically controlled damper, and an electronic control panel. The main frame includes a front stand, a rear stand, a front support, a rear support, and an upright. The seat is secured on the rear support of the main frame. The backrest is secured on the upright of the main frame, and corresponds to the seat. The swing unit is swingably mounted on the upright of the main frame. The swing unit and the backrest are located at two opposite sides of the upright. The swing unit includes two handlebars extending from the upright of the main frame to the seat respectively. The magnetically controlled damper has a first end pivotally connected with the swing unit and a second end pivotally connected with the main frame. The magnetically controlled damper includes a cylinder, a drive shaft, a transmission mechanism, a generating unit, a threaded sleeve, a threaded rod, and a driving belt. The drive shaft is movable linearly in the cylinder. The generating unit includes a rotation shaft, a rotor, a plurality of magnets, a coil module, and a belt wheel. The threaded sleeve is connected with the drive shaft, and is moved linearly in concert with the drive shaft. The threaded sleeve is screwed onto the threaded rod. The transmission mechanism is connected with and driven by the threaded rod. The driving belt is mounted between the transmission mechanism and the belt wheel. The belt wheel is secured on the rotation shaft to rotate the rotation shaft. The rotor is secured on and rotated by the rotation shaft. The magnets are secured on and rotated in concert with the rotor. The magnets surround the coil module. The electronic control panel is mounted on the main frame, and is electrically connected with the magnetically controlled damper.

According to the primary advantage of the present invention, the magnetically controlled damper is arranged in rear of the seat to reduce the whole volume of the exercising device.

According to another advantage of the present invention, the magnetically controlled damper has reduced length and width, such that it has a smaller volume, occupies a smaller space, and has a lighter weight.

According to a further advantage of the present invention, the swing unit has a simplified structure, has fewer parts, and is assembled easily.

According to a further advantage of the present invention, the magnetically controlled damper has a first end pivotally connected with the swing unit and a second end pivotally connected with the main frame, such that the magnetically controlled damper is assembled easily and conveniently, to reduce the cost of assembly.

According to a further advantage of the present invention, Further, the electronic control panel controls the resistance required by the magnetically controlled damper, such that the user regulates the damping force freely according to the practical requirement.

Further, the electronic control panel controls the resistance required by the magnetically controlled damper, such that the user regulates the damping force freely according to the practical requirement.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
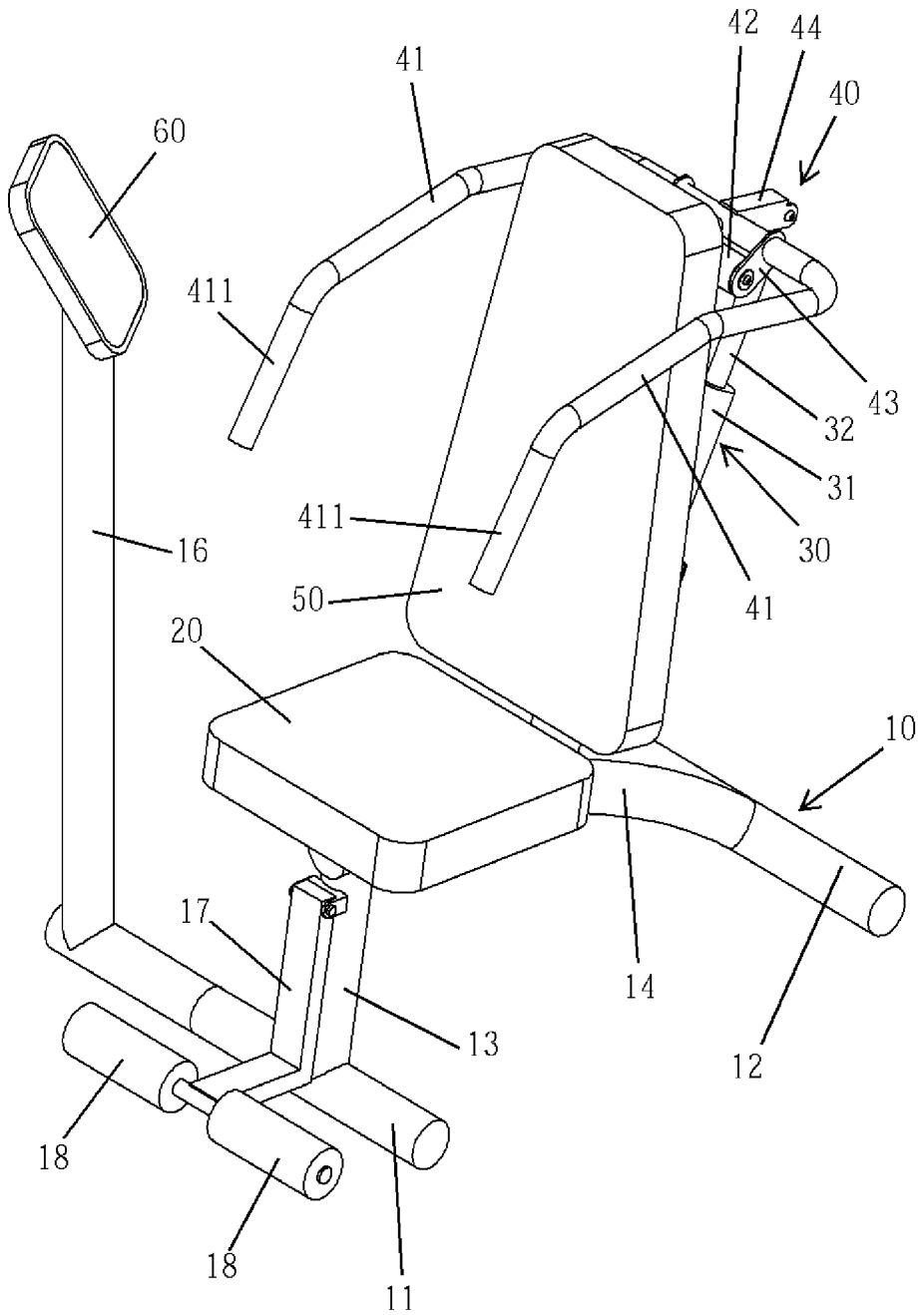
FIG. 1 is a perspective view of an exercising device in accordance with the preferred embodiment of the present invention.

Referring to the drawings and initially to FIGS. 1-8, an exercising device in accordance with the preferred embodiment of the present invention comprises a main frame 10, a seat 20, a backrest 50, a swing unit 40, a magnetically controlled damper 30, and an electronic control panel 60.

The main frame 10 includes a front stand 11, a rear stand 12, a front support 13, a rear support 14, and an upright 15. The seat 20 is secured on the rear support 14 of the main frame 10. The backrest 50 is secured on the upright 15 of the main frame 10, and corresponds to the seat 20. The swing unit 40 is swingably mounted on the upright 15 of the main frame 10. The swing unit 40 and the backrest 50 are located at two opposite sides of the upright 15. The swing unit 40 includes two handlebars 41 extending from the upright 15 of the main frame 10 to the seat 20 respectively.

The magnetically controlled damper 30 has a linear retractable structure, and has a first end pivotally connected with the swing unit 40 and a second end pivotally connected with the main frame 10. The magnetically controlled damper 30 includes a cylinder 31, a drive shaft 32, a transmission mechanism 33, a generating unit 34, a threaded sleeve (or bushing or nut or buckle) 35, a threaded rod 36, and a driving belt 37.

The cylinder 31 is pivotally connected with the main frame 10. The drive shaft 32 is pivotally connected with the swing unit 40 and is movable linearly in the cylinder 31. The transmission mechanism 33 has a wheel structure. The generating unit 34 includes a rotation shaft 341, a rotor 342, a plurality of magnets 343, a coil module 344, and a belt wheel 345. The threaded sleeve 35 is connected with the drive shaft 32, and is moved linearly in concert with the drive shaft 32. The threaded sleeve 35 is screwed onto the threaded rod 36. The threaded sleeve 35 has an internal thread screwed onto an external thread of the threaded rod 36. The transmission mechanism 33 is connected with and driven by the threaded rod 36. The driving belt 37 is mounted between the transmission mechanism 33 and the belt wheel 345. The belt wheel 345 is secured on the rotation shaft 341 to rotate the rotation shaft 341. The rotor 342 is secured on and rotated by the rotation shaft 341. The coil module 344 is disposed in the rotor 342 and corresponds to the magnets 343. The magnets 343 surround the coil module 344. The magnets 343 are secured on and rotated in concert with the rotor 342. When the rotor 342 is rotated, the magnets 343 are rotated relative to the coil module 344.

The electronic control panel 60 is mounted on the main frame 10, and is electrically connected with the magnetically controlled damper 30 to control a damping resistance.

Figure 6:
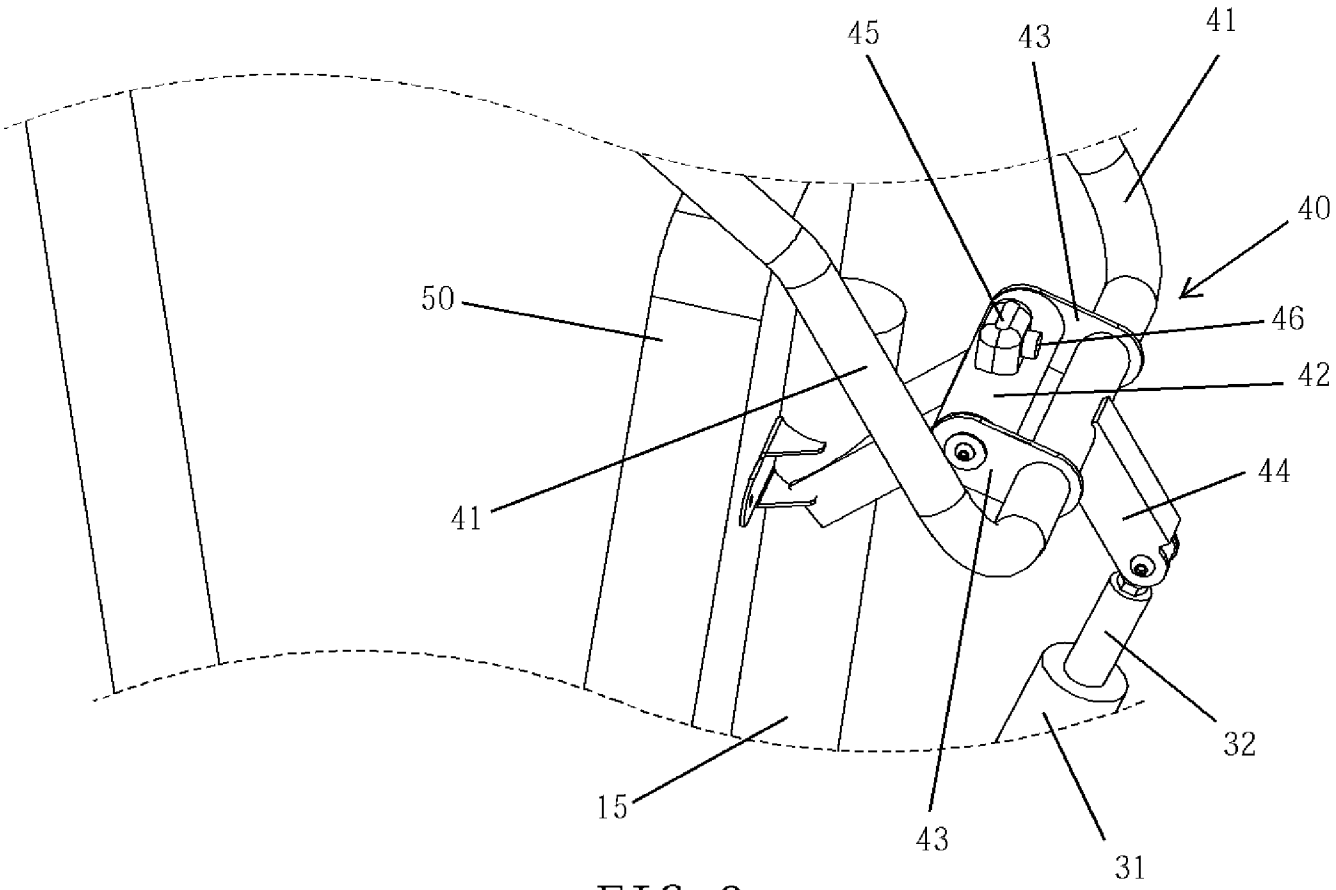
FIG. 6 is a locally enlarged operational view of the exercising device as shown in FIG. 1 in use.
Figure 7:
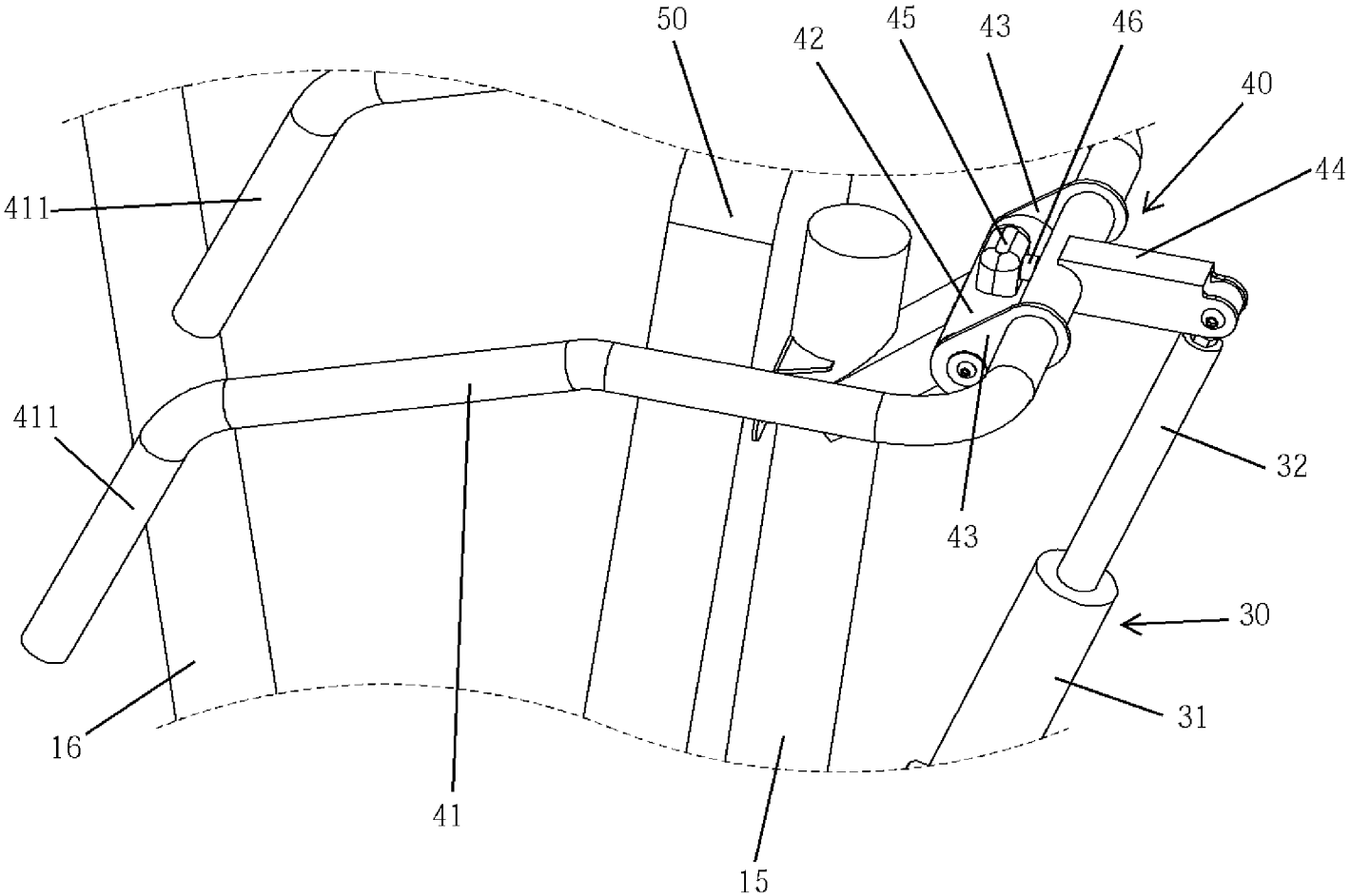
FIG. 7 is another locally enlarged operational view of the exercising device as shown in FIG. 1 in use.
Figure 8:
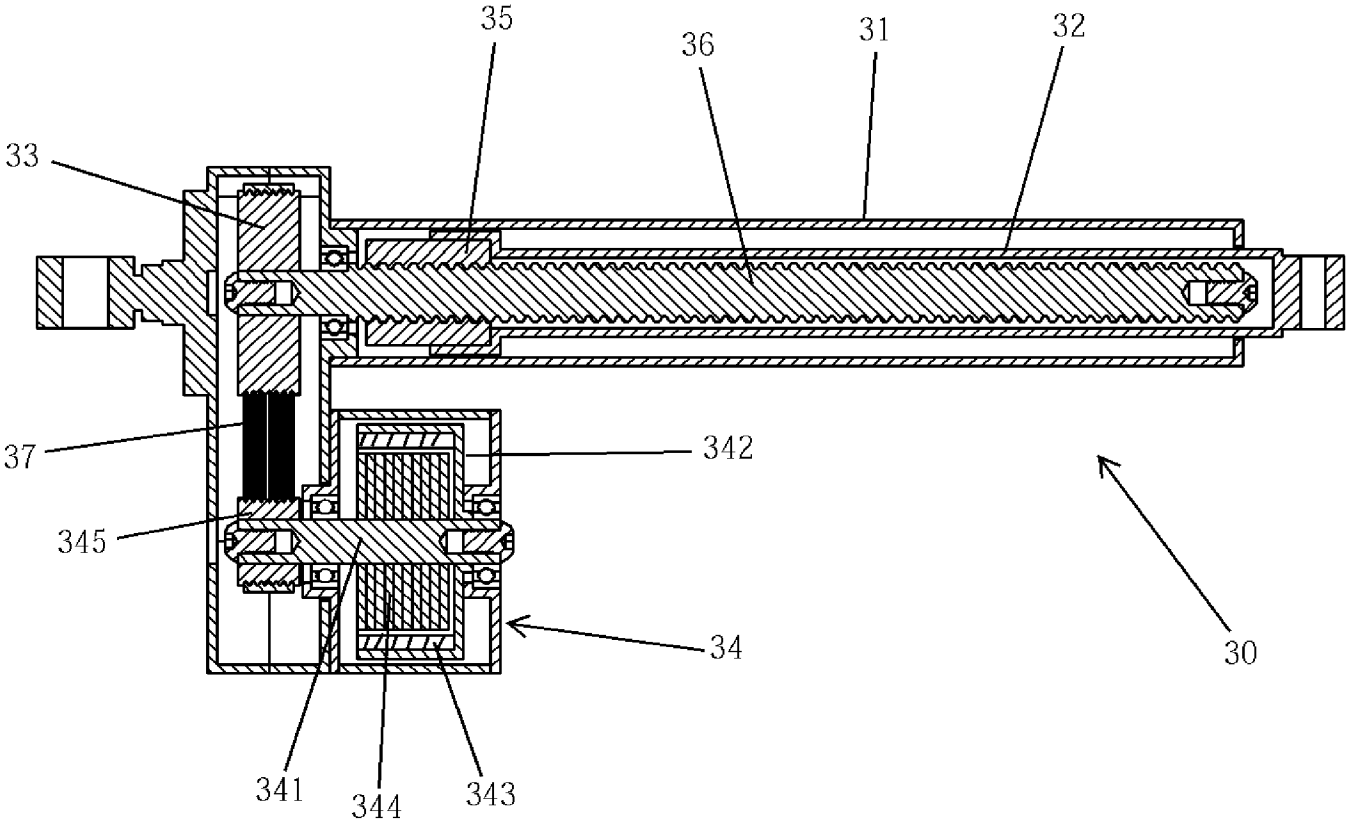
FIG. 8 is a cross-sectional view of a magnetically controlled damper of the exercising device in accordance with the preferred embodiment of the present invention.
Figure 9:
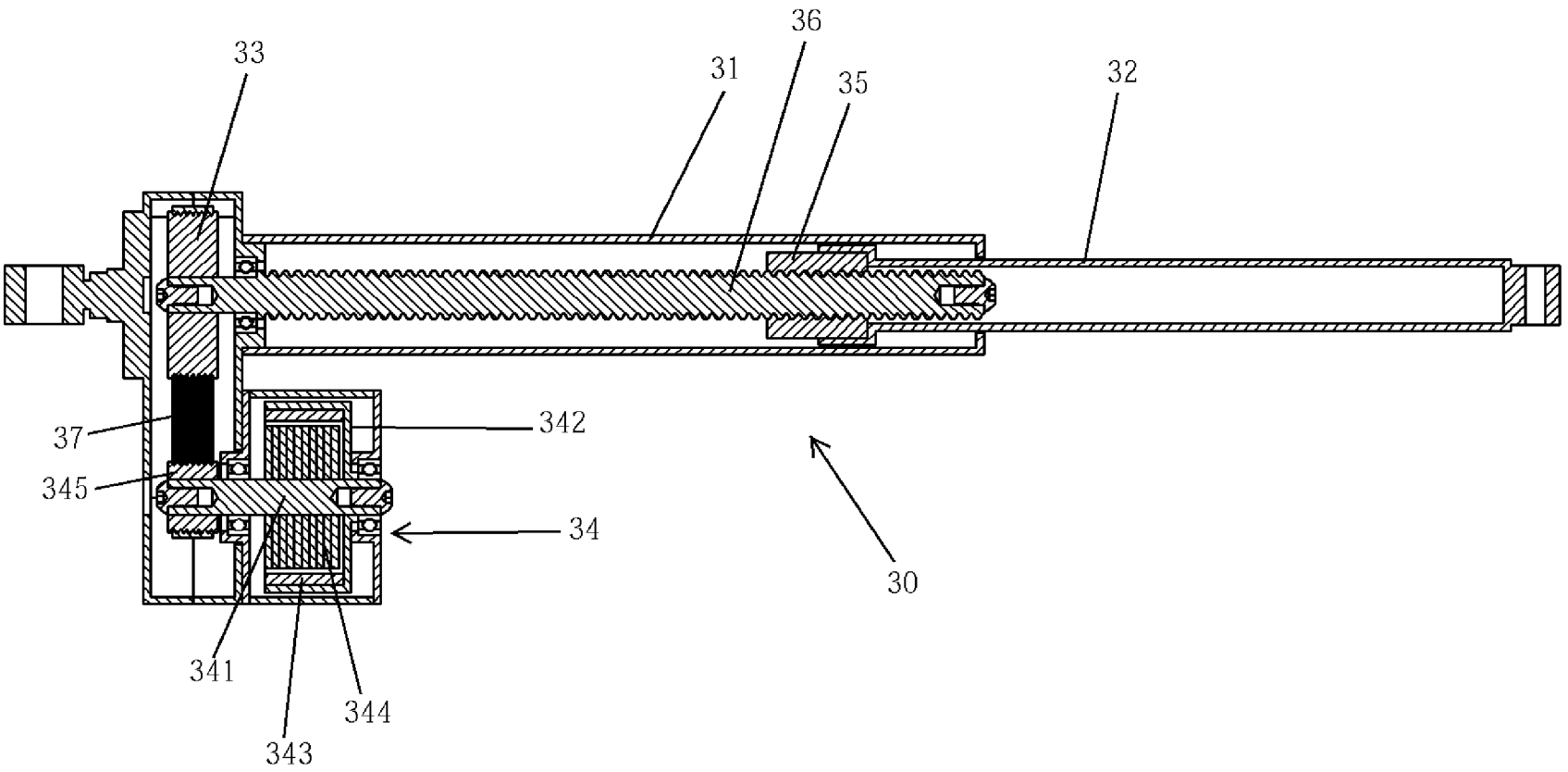
FIG. 9 is a schematic operational view of the exercising device as shown in FIG. 8 in use.

In practice, referring to FIGS. 8 and 9 with reference to FIGS. 1-7, when the drive shaft 32 is pulled and moved outward relative to the cylinder 31 as shown in FIG. 9, the threaded sleeve 35 is moved with the drive shaft 32, and the threaded rod 36 is driven to rotate by the threaded sleeve 35. When the threaded rod 36 is rotated, the transmission mechanism 33 is driven to drive the driving belt 37 which drives the belt wheel 345 which drives the rotation shaft 341 which drives the rotor 342 which performs a cycle movement and drives the magnets 343, such that the magnets 343 are rotated relative to the coil module 344. In such a manner, when the magnets 343 are rotated relative to the coil module 344, an electromagnetic load is formed and produces a torque to provide buffering and damping to a linear movement of the drive shaft 32, and to provide a resistance to a swinging motion of the two handlebars 41 of the swing unit 40.

In the preferred embodiment of the present invention, the front support 13 has a first end connected with the front stand 11, the rear support 14 has a first end connected with a second end of the front support 13, and a second end connected with the rear stand 12, and the upright 15 is mounted on the rear support 14.

In the preferred embodiment of the present invention, the main frame 10 further includes a foot support 17 mounted on and located in front of the front support 13. The foot support 17 is provided with two footrests 18.

In the preferred embodiment of the present invention, the backrest 50 is perpendicular to the seat 20.

In the preferred embodiment of the present invention, each of the two handlebars 41 has a first end provided with a grip 411. Each of the two handlebars 41 has a second end. The second ends of the two handlebars 41 are connected and form a connection. The swing unit 40 further includes a connecting member 42 secured to the upright 15 of the main frame 10, two pivot ears (or levers) 43 each having a first end pivotally connected with the connecting member 42, and a second end pivotally connected with the connection of the two handlebars 41, and a swinging member 44 having a first end secured to the connection of the two handlebars 41, and a second end pivotally connected with the first end of the magnetically controlled damper 30. The second end of the magnetically controlled damper 30 is pivotally connected with the upright 15 of the main frame 10. The connection of the two handlebars 41 is arranged between the two pivot ears 43.

In the preferred embodiment of the present invention, the second end of the swinging member 44 is pivotally connected with the drive shaft 32, and the cylinder 31 is pivotally connected with the upright 15 of the main frame 10.

In the preferred embodiment of the present invention, the swing unit 40 further includes a stop member 45 mounted on the connecting member 42, and the connection of the two handlebars 41 is moved to rest on the stop member 45. Thus, when the two handlebars 41 are moved downward to a predetermined position, the connection of the two handlebars 41 touches and is stopped by the stop member 45, to restrict the downward swinging angle of the two handlebars 41.

In the preferred embodiment of the present invention, the stop member 45 has a side provided with a resilient abutting block 46, and the connection of the two handlebars 41 is moved to rest on the resilient abutting block 46.

In the preferred embodiment of the present invention, the main frame 10 further includes a support post 16, and the electronic control panel 60 is secured on the support post 16 of the main frame 10, and is arranged at a side of the seat 20.

In the preferred embodiment of the present invention, the magnetically controlled damper 30 is arranged in rear of the seat 20 and the backrest 50.

Figure 2:
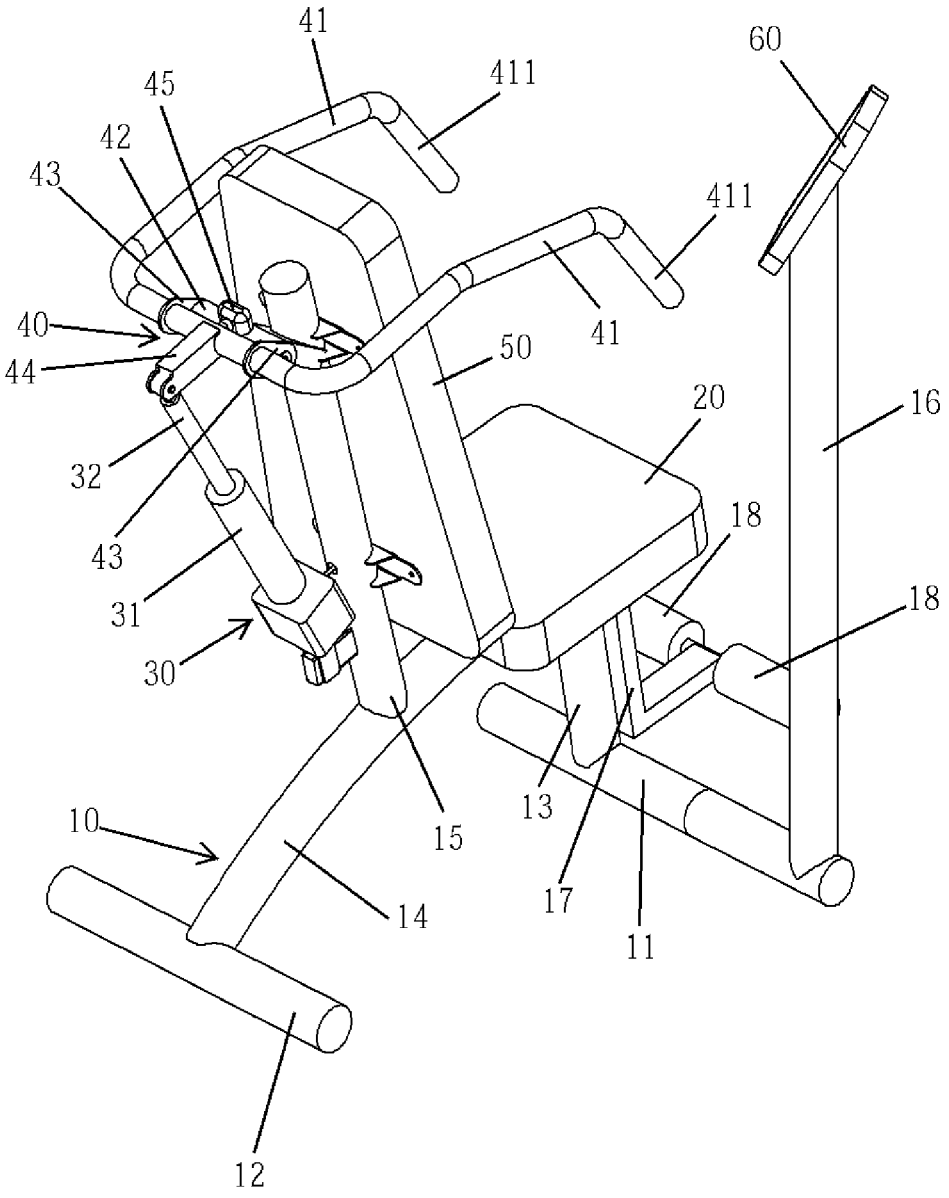
FIG. 2 is another perspective view of the exercising device in accordance with the preferred embodiment of the present invention.
Figure 3:
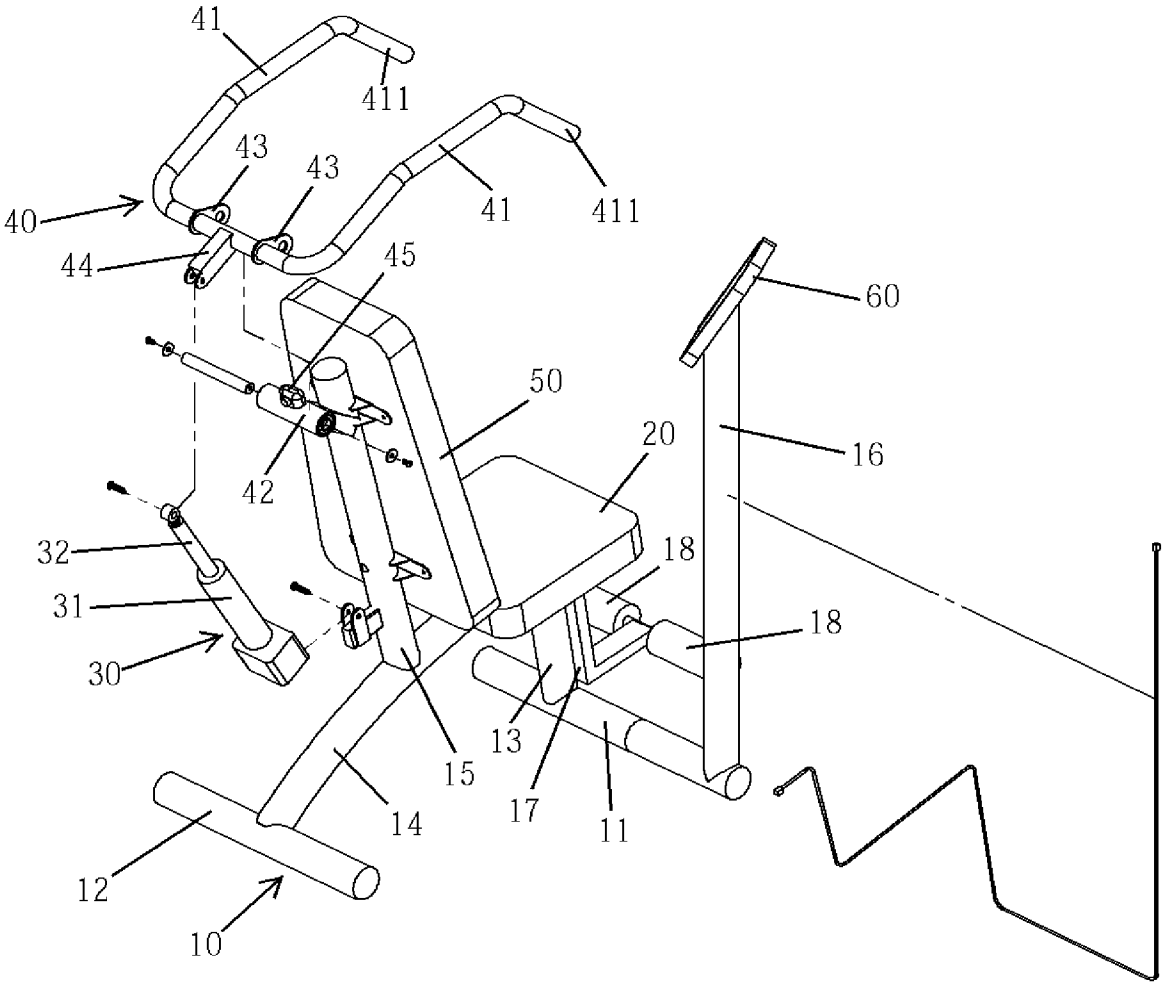
FIG. 3 is a partial exploded perspective view of the exercising device in accordance with the preferred embodiment of the present invention.
Figure 4:
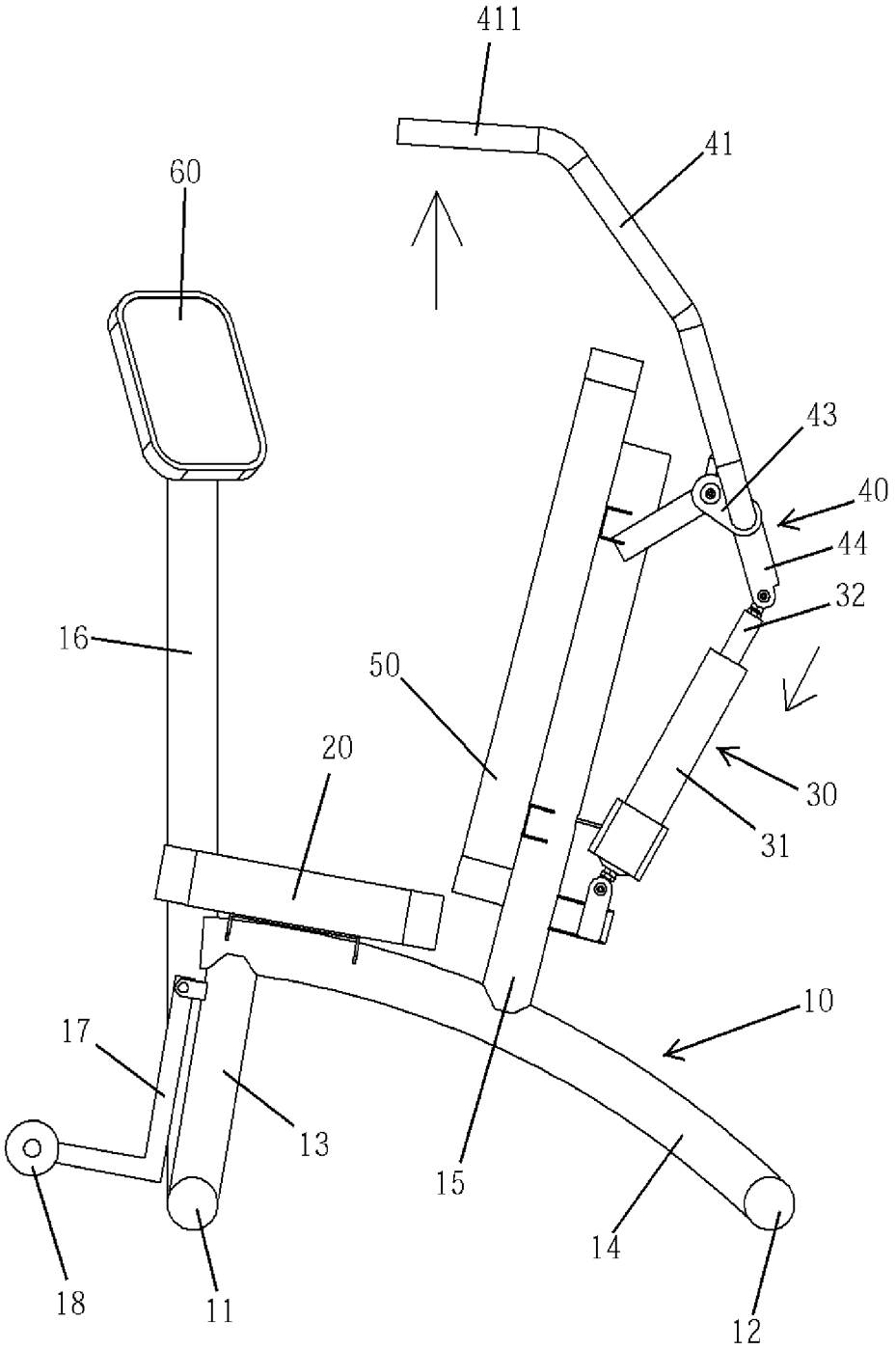
FIG. 4 is a side operational view of the exercising device as shown in FIG. 1 in use.
Figure 5:
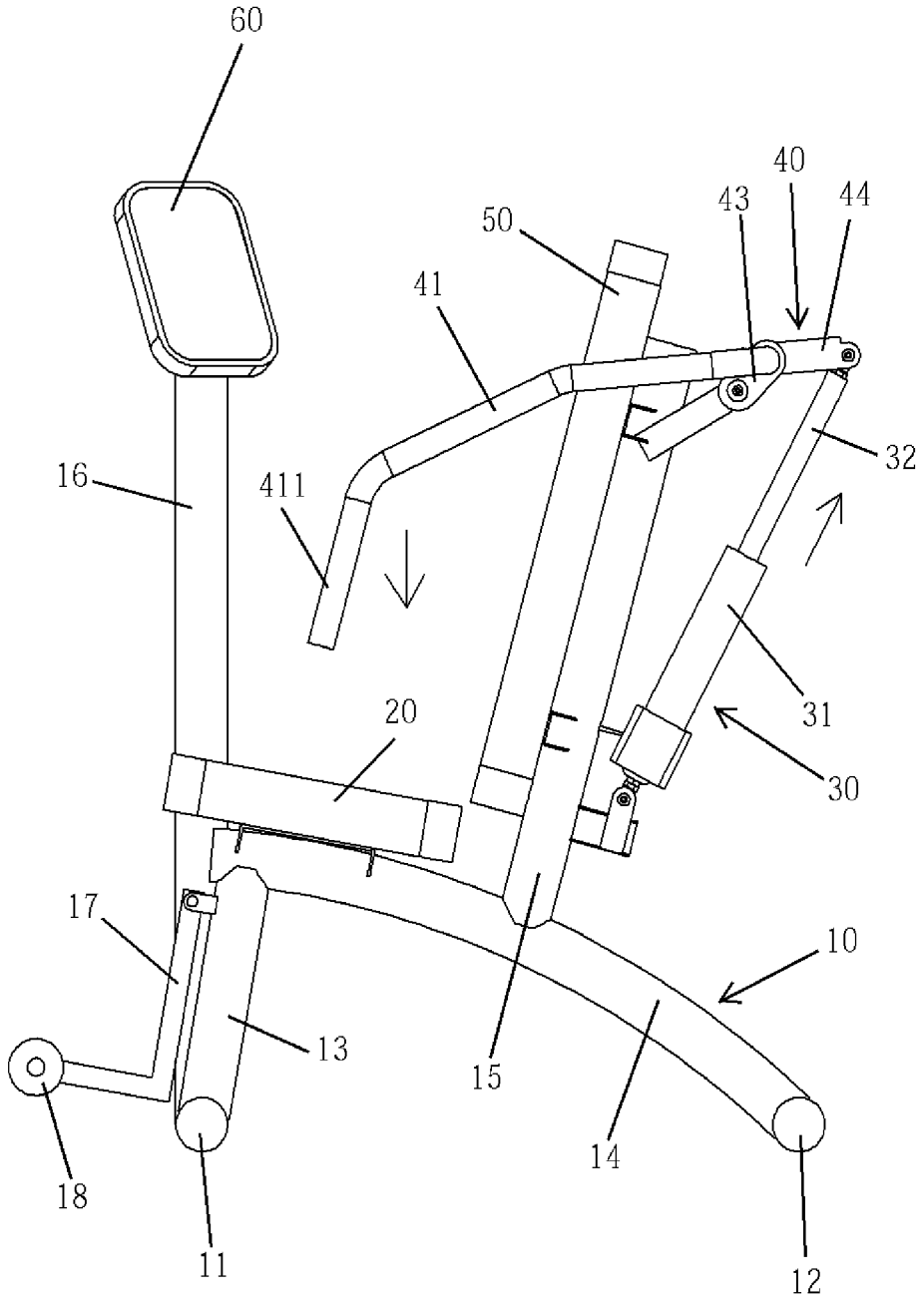
FIG. 5 is another side operational view of the exercising device as shown in FIG. 1 in use.

In operation, referring to FIGS. 4-9 with reference to FIGS. 1-3, after the user is seated on the seat 20, the electronic control panel 60 is used to preset the resistance required by the magnetically controlled damper 30. When the two handlebars 41 are pushed upward by the user as shown in FIGS. 4 and 6, the swing unit 40 also swings, and the swinging member 44 are moved and pivoted simultaneously, such that the drive shaft 32 is pushed downward to retract into the cylinder 31. When the two handlebars 41 are pulled downward by the user as shown in FIGS. 5 and 7, the swing unit 40 swings reversely, and the swinging member 44 are moved and pivoted simultaneously, such that the drive shaft 32 is pulled upward to extend from the cylinder 31. At this time, when the two handlebars 41 are moved downward to a predetermined position, the connection of the two handlebars 41 touches and is stopped by the resilient abutting block 46 of the stop member 45 as shown in FIG. 7, to restrict the downward swinging angle of the two handlebars 41. In such a manner, the user pushes the two handlebars 41 upward and pulls the two handlebars 41 downward to move along an arcuate track or orbit reciprocatingly, so as to achieve an exercising or rehabilitating purpose.

Accordingly, the magnetically controlled damper 30 is arranged in rear of the seat 20 to reduce the whole volume of the exercising device. In addition, the magnetically controlled damper 30 has reduced length and width, such that it has a smaller volume, occupies a smaller space, and has a lighter weight. Further, the swing unit 40 has a simplified structure, has fewer parts, and is assembled easily. Further, the magnetically controlled damper 30 has a first end pivotally connected with the swing unit 40 and a second end pivotally connected with the main frame 10, such that the magnetically controlled damper 30 is assembled easily and conveniently, to reduce the cost of assembly. Further, the electronic control panel 60 controls the resistance required by the magnetically controlled damper 30, such that the user regulates the damping force freely according to the practical requirement.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. An exercising device comprising:

a main frame, a seat, a backrest, a swing unit, a magnetically controlled damper, and an electronic control panel;

wherein:

the main frame includes a front stand, a rear stand, a front support, a rear support, and an upright;

the seat is secured on the rear support of the main frame;

the backrest is secured on the upright of the main frame, and corresponds to the seat;

the swing unit is swingably mounted on the upright of the main frame;

the swing unit and the backrest are located at two opposite sides of the upright;

the swing unit includes two handlebars extending from the upright of the main frame to the seat respectively;

the magnetically controlled damper has a first end pivotally connected with the swing unit and a second end pivotally connected with the main frame;

the magnetically controlled damper includes a cylinder, a drive shaft, a transmission mechanism, a generating unit, a threaded sleeve, a threaded rod, and a driving belt;

the drive shaft is movable linearly in the cylinder;

the generating unit includes a rotation shaft, a rotor, a plurality of magnets, a coil module, and a belt wheel;

the threaded sleeve is connected with the drive shaft, and is moved linearly in concert with the drive shaft;

the threaded sleeve is screwed onto the threaded rod;

the transmission mechanism is connected with and driven by the threaded rod;

the driving belt is mounted between the transmission mechanism and the belt wheel;

the belt wheel is secured on the rotation shaft to rotate the rotation shaft;

the rotor is secured on and rotated by the rotation shaft;

the magnets are secured on and rotated in concert with the rotor;

the magnets surround the coil module; and the electronic control panel is mounted on the main frame, and is electrically connected with the magnetically controlled damper.

2. The exercising device of claim 1, wherein:

the front support has a first end connected with the front stand;

the rear support has a first end connected with a second end of the front support, and a second end connected with the rear stand; and the upright is mounted on the rear support.

3. The exercising device of claim 1, wherein:

the main frame further includes a foot support mounted on and located in front of the front support; and the foot support is provided with two footrests.

4. The exercising device of claim 1, wherein the backrest is perpendicular to the seat.

5. The exercising device of claim 1, wherein:

each of the two handlebars has a first end provided with a grip;

each of the two handlebars has a second end;

the second ends of the two handlebars are connected and form a connection;

the swing unit further includes a connecting member secured to the upright of the main frame, two pivot ears each having a first end pivotally connected with the connecting member, and a second end pivotally connected with the connection of the two handlebars, and a swinging member having a first end secured to the connection of the two handlebars, and a second end pivotally connected with the first end of the magnetically controlled damper;

the second end of the magnetically controlled damper is pivotally connected with the upright of the main frame; and the connection of the two handlebars is arranged between the two pivot ears.

6. The exercising device of claim 1, wherein the swing unit further includes a stop member mounted on the connecting member, and the connection of the two handlebars is moved to rest on the stop member.

7. The exercising device of claim 1, wherein:

the main frame further includes a support post; and the electronic control panel is secured on the support post of the main frame, and is arranged at a side of the seat.

8. The exercising device of claim 5, wherein the second end of the swinging member is pivotally connected with the drive shaft, and the cylinder is pivotally connected with the upright of the main frame.

9. The exercising device of claim 6, wherein the stop member has a side provided with a resilient abutting block, and the connection of the two handlebars is moved to rest on the resilient abutting block.

10. The exercising device of claim 1, wherein the magnetically controlled damper is arranged in rear of the seat and the backrest.

11. The exercising device of claim 1, wherein the transmission mechanism has a wheel structure.

* * * * *